US005762061A

United States Patent [19]

Bevan

[11] Patent Number: 5,762,061

[45] Date of Patent: Jun. 9, 1998

[54] SPLITTING APPARATUS

[76] Inventor: David Maurice Bevan, 4 Court Lodge, Shorne, Kent, DA12 3EQ, England

[21] Appl. No.: 578,568

[22] PCT Filed: Jun. 15, 1994

[86] PCT No.: PCT/GB94/01287

§ 371 Date: Jan. 31, 1996

§ 102(e) Date: Jan. 31, 1996

[87] PCT Pub. No.: WO95/00306

PCT Pub. Date: Jan. 5, 1995

[30] Foreign Application Priority Data

Jun. 18, 1993 [GB] United Kingdom ..... 9312617
Oct. 15, 1993 [GB] United Kingdom ..... 9321297

[51] Int. Cl.[6] ..... B28D 1/32

[52] U.S. Cl. ..... 125/23.01; 125/30.01

[58] Field of Search ..... 225/93, 103; 125/23.01, 125/12, 24, 30.01, 35, 40

[56] References Cited

U.S. PATENT DOCUMENTS

| | | | |
|---|---|---|---|
| 2,053,043 | 9/1936 | Patterson | 125/23.01 |
| 2,372,784 | 4/1945 | Jansen et al. | 125/23.01 |
| 2,613,661 | 10/1952 | Huber | 125/23.01 |
| 2,777,438 | 1/1957 | Mangis | 125/23.01 |
| 2,779,324 | 1/1957 | Schlough et al. | 125/23.01 |
| 2,874,688 | 2/1959 | Biesanz et al. | 125/23.01 |
| 2,888,915 | 6/1959 | Entz et al. | 125/23.01 |
| 2,933,079 | 4/1960 | Gutting | 125/23.01 |
| 3,161,190 | 12/1964 | Stephens et al. | 125/23.01 |
| 3,392,719 | 7/1968 | Clanton et al. | 125/23.01 |
| 3,424,144 | 1/1969 | Giconi | 125/23.01 |
| 3,439,664 | 4/1969 | Sylvester | 125/23 |
| 3,492,984 | 2/1970 | Harper | 125/23.01 |
| 3,886,927 | 6/1975 | Chattin | 125/23.01 |
| 5,570,678 | 11/1996 | Waggoner et al. | 125/23.01 |

FOREIGN PATENT DOCUMENTS

| | | |
|---|---|---|
| 1 509 160 | 12/1966 | France . |
| 2 547 527 | 6/1983 | France . |
| 2 559 417 | 2/1984 | France . |
| 7314538 | 4/1973 | Germany . |
| 1026610 | 4/1966 | United Kingdom . |

*Primary Examiner*—Timothy V. Eley
*Assistant Examiner*—Derris H. Banks
*Attorney, Agent, or Firm*—Kinney & Lange, P.A.

[57] ABSTRACT

Apparatus for splitting blocks, the apparatus comprising a base (1) which supports a blade (2) with its splitting edge protruding a distance no greater than 5 mm above the base surface, guide ways (4) upstanding from the base (1) and positioned one to each side of the blade (2), and an opposite bladed member (5, 6) movable between and within the guide ways (4) along a vertical path which contains the respective edges of the blade (2) and the bladed member (5, 6). The surface of the base (1) is formed with corrugations (3) which extend in a direction normal to the edge of the blade (2). The base includes an upstanding wall lying to one side of the blade (2) and being provided with markings in the form of a rule.

10 Claims, 1 Drawing Sheet

SPLITTING APPARATUS

Figure 1:
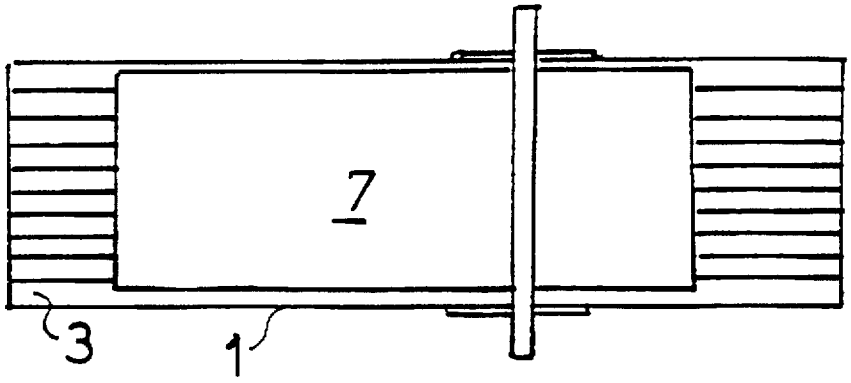

This invention relates to apparatus for splitting a building block, brick, paving stone, coping stone, pathway block or the like (hereinafter referred to simply as "blocks") into two or more pieces. More especially the invention is directed to apparatus for splitting a block to produce a smaller block of a required length.

When using such items as internal thermal blocks for building, for example, an internal wall of a house, it is more than likely that a significant number of blocks will need to be cut to length. Hitherto such blocks have conventionally been cut using either a saw or a bolster and hammer to create stress lines across the block width. Similar methods are presently employed to cut other types of bricks, stones and blocks as referred to above.

To use a saw to cut building blocks to length is both time consuming and unpleasant because of the high volume of dust created. With experience, blocks to an approximate size can be cut using a bolster and hammer. However the length of block produced is often imprecise and damage often occurs to the edges of the block. Without experience, attempts to split building blocks using a bolster and hammer are frequently unsuccessful.

A cutting machine is disclosed in FR-A-2559417 which comprises a frame including a base above which a cutting blade protrudes. A second blade is movable downwardly into contact with a brick or block supported on the frame base to cut the same.

The present invention sets out to provide splitting apparatus which enables blocks to be consistently and accurately cut to length.

According to the present invention in one aspect there is provided apparatus for splitting blocks, which comprises a base which supports a blade with its splitting edge above the surface of the base and a bladed member movable towards and away from the base to impact on a block supported thereby, the apparatus being characterized in that the blade protrudes a distance no greater than 5 mm above the base surface, and in that the bladed member is movable between and within guide ways positioned one to each side of the blade along a substantially vertical path which contains the respective edges of the blade and the bladed member.

The blade whose edge protrudes from the base of the apparatus is preferably a continuous blade which extends across at least the major part of the width of the base. The splitting edge of the blade is preferably tapered and the blade may be removable from the base.

The height of the cutting edge of the blade above the surface of the base may be of the order of between 2 mm and 4 mm; a typical height is 3 mm. The base may be generally horizontal and may be formed in a single piece. Alternatively, the base may be formed in two or more separate sections each of which may be inclined one with another. The surface of the base may be generally flat or may be formed with corrugations which extend in a direction generally normal to the splitting edge of the blade.

The base may include markings in the form of a rule to indicate the distance between a marked point or line and the protruding splitting edge of the blade. The surface of the base may include to one or each of its sides an upstanding member or wall whose end face lies to one side of the protruding splitting edge of the blade. This member or wall may include markings in the form of a rule.

Figure 2:
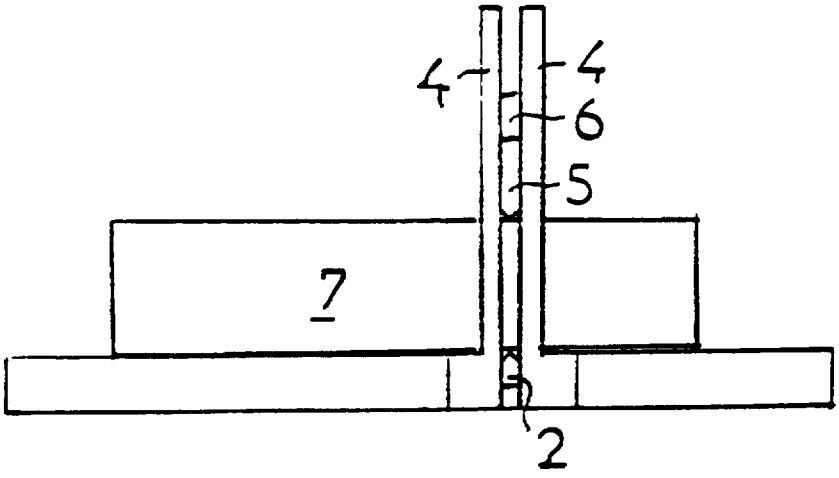

The invention will now be described by way of example only with reference to the accompanying diagrammatic drawings in which:

FIG. 1 is a side view of apparatus in accordance with the invention with a block to be split supported thereby; and FIG. 2 is a plan view from above of the apparatus and block illustrated in FIG. 1.

The apparatus illustrated in FIGS. 1 and 2 includes a base 1 produced from wood, metal or other suitable material. A blade 2 is supported by the base and is formed with a splitting edge which protrudes a small distance above the base surface and which extends across the entire width of the base surface. The base 1 is formed with a plurality of corrugations 3 which extend in a direction generally normal to the splitting edge of the blade 2. In an alternative construction, the blade extends over only a major part of the base width. The blade 2 is formed with a tapered edge and is located within a suitably shaped slot formed in the corrugations of the base 1. In the arrangement illustrated, the blade 2 can selectively be removed, reversed and replaced. Alternatively, the blade 2 may be formed integrally with the base. As shown the blade 2 is positioned closer to one end of the base 1 than the other. In a preferred arrangement, the blade 2 is positioned at a distance of, for example, 5½" from the right hand end of the base 1 For producing split blocks for use as returns and reveals. As mentioned previously, the blade 2 protrudes a relatively small height above the base surface, this height being no greater than 5 mm and being preferably between 2 and 4 mm. A typical height is 3 mm or ⅛".

The base may be marked with linear measurements to provide a measure of distance from the blade 2.

Upstanding guideways 4 are provided to each side of the base for receiving and retaining a bladed member 5. The path defined by the guideways 4 extends generally vertically between the splitting edge of the blade 2 and the upper extent of the guideways passing through the edges of the bladed member 6. The member 5 includes a head 6.

A block 7 to be cut is shown positioned on the base.

In use of the apparatus illustrated, the block 7 is positioned on the base 1 and rests on the splitting edge of the blade 2 with the blade immediately below the intended fracture plane of the block. The measurement markings are provided to ensure that the block is correctly positioned on the base.

The bladed member 5 is then located within fine guideways 4 and placed with its edge in contact with the upper face of the block immediately above the intended fracture plane of the block. At this time, the splitting edge of the blade 2 and blade member 5 lie generally in a common vertical plane. The head 6 is then struck using,for example, a hammer to cause the block to fracture about the Diane containing the edge of the blade 2 and the edge of the bladed member 5.

The small distance which the splitting edge of the blade 2 protrudes above the surface of the base 1 has been found to be critical for consistently effecting a clean fracture of a block about its intended fracture plane. If this distance is greater than 5 mm, consistent clean fractures are not possible.

Use of the apparatus in the manner described consistently produces split blocks of a required length. Means may be provided to support the underside of a block where, for example, only a very small (e.g. 1") needs to be sheared from the block end. The support may be provided by, for example, a layer of sand or like material.

It will be appreciated that the foregoing is merely exemplary of the apparatus in accordance with the invention and that modifications can readily be made thereto without departing from the true scope of the invention.

I claim:

1. Apparatus for splitting blocks, the apparatus comprising a base having a base surface, a blade having a splitting edge, the blade supported by the base in a fixed position relative to the base with its splitting edge protruding a distance no greater than 5 mm above the base surface, guide ways upstanding from the base and positioned one to each side of the blade, and a biased member moveable between and within the guide ways along a substantially vertical path which contains respective edges of the blade and the bladed member.

2. The apparatus as claimed in claim 1 wherein the blade whose edge protrudes from the base of the apparatus is a continuous blade which extends across at least the major part of the width of the base.

3. The apparatus as claimed in claim 1 wherein the splitting edge of the blade is tapered.

4. The apparatus as claimed in claim 1 wherein the blade is removable from the base.

5. The apparatus as claimed in claim 1 wherein the height of the cutting edge of the blade above the surface of the base is of the order of between 2 mm and 4 mm.

6. The apparatus as claimed in claim 1 wherein the base is generally horizontal and is formed as a single piece.

7. The apparatus as claimed in claim 1 wherein the surface of the base is generally flat.

8. The apparatus as claimed in claim 1 wherein the surface of the base is formed with corrugations which extend in a direction generally normal to the splitting edge of the blade.

9. The apparatus as claimed in claim 1 wherein the surface of the base includes along one or each of its sides and upstanding member or wall whose end face lies to one side of the protruding splitting edge of the blade.

10. The apparatus as claimed in claim 1 and further comprising a striking head attached to and mounted over the bladed member.

* * * * *

UNITED STATES PATENT AND TRADEMARK OFFICE

CERTIFICATE OF CORRECTION

PATENT NO. : 5,762,061

DATED : JUNE 9, 1998

INVENTOR(S) : DAVID M. BEVAN

It is certified that error appears in the above-identified patent and that said Letters Patent is hereby corrected as shown below:

Col. 2, line 43, delete "fine", insert --the--

Col. 2, line 49, delete "Diane", insert --plane--

Col. 3, line 8, delete "biased", insert --bladed--

Signed and Sealed this

Twelfth Day of October, 1999

*Attest:*

Q. TODD DICKINSON

*Attesting Officer*

*Acting Commissioner of Patents and Trademarks*